US005905465A

United States Patent [19]

Olson et al.

[11] Patent Number: 5,905,465

[45] Date of Patent: May 18, 1999

[54] ANTENNA SYSTEM

[75] Inventors: Steven C. Olson, Broomfield; Kerry R. Stewart, Arvada; Jeffrey David Goodwin, Longmont; David John Drew, Westminster; Travis Lee Newton, Johnstown, all of Colo.

[73] Assignee: Ball Aerospace & Technologies Corp., Broomfield, Colo.

[21] Appl. No.: 08/842,375

[22] Filed: Apr. 23, 1997

[51] Int. Cl.[6] ..... H01Q 1/38

[52] U.S. Cl. ..... 343/700 MS; 343/365; 343/795; 343/895; 343/715; 33/34

[58] Field of Search ..... 343/795, 895, 343/715, 700 MS, 721

[56] References Cited

U.S. PATENT DOCUMENTS

| | | | |
|---|---|---|---|
| Re. 29,911 | 2/1979 | Munson | 343/700 |
| 3,887,925 | 6/1975 | Ranghelli | 343/795 |
| 4,291,312 | 9/1981 | Kaloi | 343/700 MS |
| 4,614,947 | 9/1986 | Rammos | 343/778 |
| 4,772,890 | 9/1988 | Bowen et al. | 343/700 |
| 4,825,220 | 4/1989 | Edward et al. | 343/795 |
| 4,829,309 | 5/1989 | Tsukamoto et al. | 343/700 |
| 4,829,314 | 5/1989 | Barbier et al. | 343/778 |
| 4,914,449 | 4/1990 | Fukuzawa et al. | 343/872 |
| 4,973,972 | 11/1990 | Huang | 343/700 |
| 5,216,430 | 6/1993 | Rahm et al. | 343/700 MS |
| 5,285,212 | 2/1994 | McNiece | 343/795 |
| 5,499,033 | 3/1996 | Smith | 343/700 |
| 5,565,877 | 10/1996 | Du et al. | 343/715 |
| 5,596,337 | 1/1997 | Merenda | 343/770 |
| 5,742,258 | 4/1998 | Kumpfbeck et al. | 343/795 |

*Primary Examiner*—Robert Kim
*Assistant Examiner*—Layla G. Lauchman
*Attorney, Agent, or Firm*—Sheridan Ross P.C.

[57] ABSTRACT

The present invention relates to an antenna system that is particularly suited for use in mobile communications applications. The antenna system includes both a transmit array and a receive array in a side by side configuration. In one embodiment, the radiating elements used in each of the arrays consist of air loaded microstrip patch antennas. The elements in each array are linearly arranged and polarization diversity is utilized so that the transmit and receive arrays can be spaced closely together.

11 Claims, 21 Drawing Sheets

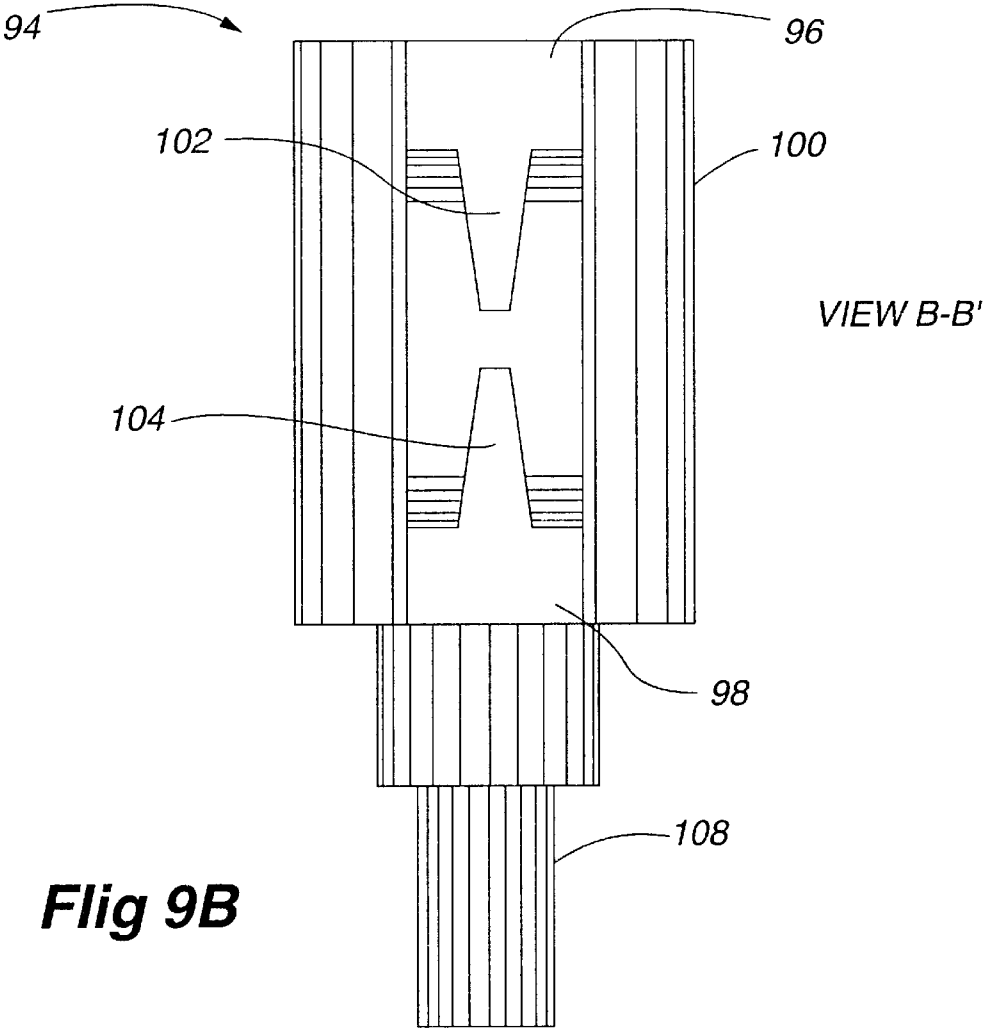
Flig 9B

ANTENNA SYSTEM

FIELD OF THE INVENTION

The present invention relates generally to antenna systems and is particularly apt for use in mobile communications applications.

BACKGROUND OF THE INVENTION

Mobile communications systems are currently being implemented at an increasing rate. Such systems generally include a plurality of geographically distributed base stations that are each responsible for servicing mobile users in a particular area, known as a cell. When a mobile user wishes to establish a communication channel with another user, the mobile user transmits a radio frequency request signal to the nearest base station. The base station receives the request signal at an antenna and subsequently transfers the request to a mobile switching center (MSC) which sets up the requested connection. The base station then acts as a radio frequency link in the communication channel until the channel is terminated.

Mobile communications systems normally employ a large number of base stations to cover a given area. As described above, each of these base stations requires at least one antenna for receiving and transmitting signals to users. The antennas are normally mounted on poles that are located at an elevated point within the cell, such as on the top of a tall building or on a mountain peak, to obtain total coverage within the cell. Because a large number of antennas are required for a typical system, it is important that the antennas be relatively inexpensive to manufacture. In addition, because of the location of the mount, it is important that the antennas be compact, lightweight, and relatively easy to install on the pole. Furthermore, the antennas should provide good performance characteristics, such as low-loss and linear operation.

In communications applications, it is very important that circuitry remain substantially linear. This is especially important in systems that utilize multiple adjacent frequency channels because nonlinearities in such systems can cause interference between individual channels of the system. That is, frequency components from one or more channels can combine as a result of the nonlinearity to form intermodulation products that appear in the frequency range of another channel. As is apparent, these intermodulation products can greatly reduce system performance. Therefore, efforts should be made to minimize system nonlinearities.

To make an antenna system more compact, a multiple layer feed arrangement can be utilized. That is, circuit structures can exist on two or more vertical layers, rather than all on the same layer, thereby reducing the overall footprint of the antenna. In such a multi-layer system, a means must be provided for coupling signals between the different layers. This coupling means must provide a relatively good impedance match between transmission structures on the different layers and should be relatively low loss. In addition, the coupling means should not create undesirable transmission modes within the antenna housing (i.e., the coupling should not radiate within the housing).

To decrease the weight of an antenna, some systems utilize air loaded transmission lines within the antenna housing to, among other things, transfer radio frequency energy between an input/output connector and each radiating element. Air loaded transmission lines, in general, require some means to suspend a center conductor a predetermined distance away from one or more nearby ground structures to achieve a required characteristic impedance. Past suspension devices invariably introduce dielectric loading to the transmission line which creates undesirable mismatches and losses on the transmission line. To reduce the effects of the mismatches, past systems placed suspension devices at quarter wave intervals along the transmission line so that reflections caused by adjacent devices would cancel. Because this practice generally requires more suspension devices than are needed for supporting/suspending the center conductors, additional weight and signal loss is added to the system.

An important consideration in designing an antenna system for use in a large communication system is ease of installation. As described above, a typical mobile system can require a multitude of antennas to cover a desired service area. Installation and servicing of these antennas can be a monumental task requiring many man-hours of labor with associated labor costs. Therefore, if the complexity of the installation process is reduced, system installation and maintenance costs can be reduced. In addition, a reduction in antenna installation complexity can reduce system installation time and increase installer safety.

SUMMARY OF THE INVENTION

The present invention relates to an antenna system that is particularly suited for use in mobile communications applications. The antenna system is compact and lightweight and is relatively inexpensive and easy to manufacture and install. In addition, the antenna system is relatively linear in operation. The antenna system has a multiple layer design that reduces the overall size of the system and a unique transition for transferring radio frequency energy from one layer to another.

In conceiving of the present invention, it was appreciated that the existence of metal to metal contact in a transmission path, or other high current area, can lead to a nonlinear circuit effect known as passive intermodulation. That is, a diode effect is created at the metal to metal junction that can result in intermodulation products between frequency components in the system. These intermodulation components can create interference between channels in the system and, therefore, are highly undesirable. In accordance with the present invention, metal to metal contact is avoided in high current areas thereby preventing the creation of passive intermods.

In one aspect of the present invention, an antenna system is provided that comprises a transition between layers that does not include metal to metal junctions. More specifically, the antenna system includes: (a) a housing; (b) a ground plane located within the housing and separating a first circuitry layer from a second circuitry layer; (c) a radiating element, having an input/output port, for transferring radio frequency energy in a predetermined operational frequency range between the input/output port and free space, the radiating element being located on the first circuitry layer; (d) a first transmission line, having a first center conductor, for use in transferring radio frequency energy between a first signal node and the input/output port of the radiating element, wherein the first transmission line and the first signal node are located on the first circuitry layer; (c) a second transmission line, having a second center conductor, for use in transferring radio frequency energy between a second signal node and a third signal node, wherein the second transmission line and the second and third signal nodes are located on the second circuitry layer; and (e) a transition for use in transferring radio frequency energy between the first signal node on the first circuitry layer and the second signal node on the second circuitry layer, wherein the transition, the first center conductor, and the second center conductor are collectively formed from a single, homogeneous metallic member having uniform composition.

The radiating element can include any type of radiating structure that is capable of transmitting/receiving radio frequency energy into/from free space. This can include, for example, a dipole, patch, spiral, monopole, loop, horn, helix, doorstop, Vivaldi, and/or notch antenna element. In a preferred embodiment, an air loaded patch is utilized. It should be appreciated that multiple radiating elements, such as in an antenna array, can also be used.

In a preferred embodiment of the present invention, the first transmission line is comprised of a microstrip transmission medium and the second transmission line is comprised of a stripline transmission medium. It should be appreciated, however, that any number of different transmission medium combinations can be implemented in accordance with the present invention.

A mode suppressor is provided for suppressing undesired transmission modes that can originate at the transition. In one embodiment, the mode suppressor includes a grounded conductive member that surrounds the transition on at least three sides. To avoid metal to metal contact, the mode suppressor can be capacitively coupled to the ground plane such that a radio frequency short exists between it and system ground.

The antenna system of the present invention can also include a connector for use in transferring radio frequency energy between the system and an exterior environment. To avoid the creation of metal to metal contact between the center conductor of the connector and a transmission line center conductor within the antenna system, the connector center conductor is capacitively coupled to the transmission line center conductor. In one embodiment, a connector is provided that includes a center conductor having a conductive strip that protrudes out of one end of the connector. A thin dielectric layer is then interposed between the conductive strip and a portion of the transmission line center conductor, thereby capacitively coupling the two structures.

The transmission media used in the antenna system of the present invention are preferably air loaded. In one embodiment of the present invention, a dielectric support means is provided for suspending transmission circuitry, such as a transmission line center conductor, a fixed distance from a ground plane. The support means includes a tapered member that has a relatively wide end for providing strength to the member and a narrow end that contacts the transmission circuitry. Because the end that contacts the transmission circuitry is relatively narrow (i.e., approximately one millimeter or less), the support means produces relatively little dielectric loading on the transmission structure. Because dielectric loading is minimized, support means do not have to be placed at fixed intervals along the transmission structure to reduce reflection. This reduces system cost, weight, and complexity, and simplifies manufacture.

In one embodiment of the antenna system, an adjustable bracket is provided for mounting the system to a vertically oriented support, such as a pole. The bracket includes a first clamp that can be secured to the pole. A brace is also provided that is pivotally connected to the antenna housing and slidably mounted to the first clamp. The bracket also includes fastening means, such as a bolt or screw, for securing the brace with respect to the first clamp. The bracket can also include alignment means, such as an alignment pin, that can temporarily lock the brace in a predetermined position with respect to the first clamp. A second clamp that is pivotally mounted to the housing is also provided.

BRIEF DESCRIPTION OF THE DRAWINGS

FIG. 8*b* also illustrates the interconnection between a connector flange and upper and lower ground planes in the antenna system;

FIGS. 9*a* and 9*b* are an isometric view and a side view, respectively, of a retainer for use in holding a transmission line center conductor a predetermined distance from a ground plane in accordance with the present invention;

DETAILED DESCRIPTION OF THE PREFERRED EMBODIMENT

The present invention relates to an antenna system that is particularly suited for use in mobile communications applications. The antenna system includes both a transmit array and a receive array in a side by side configuration. In one embodiment, the radiating elements used in each of the arrays consist of air loaded microstrip patch antennas. The elements in each array are linearly arranged and polarization diversity is utilized so that the transmit and receive arrays can be spaced closely together.

Figure 1A:
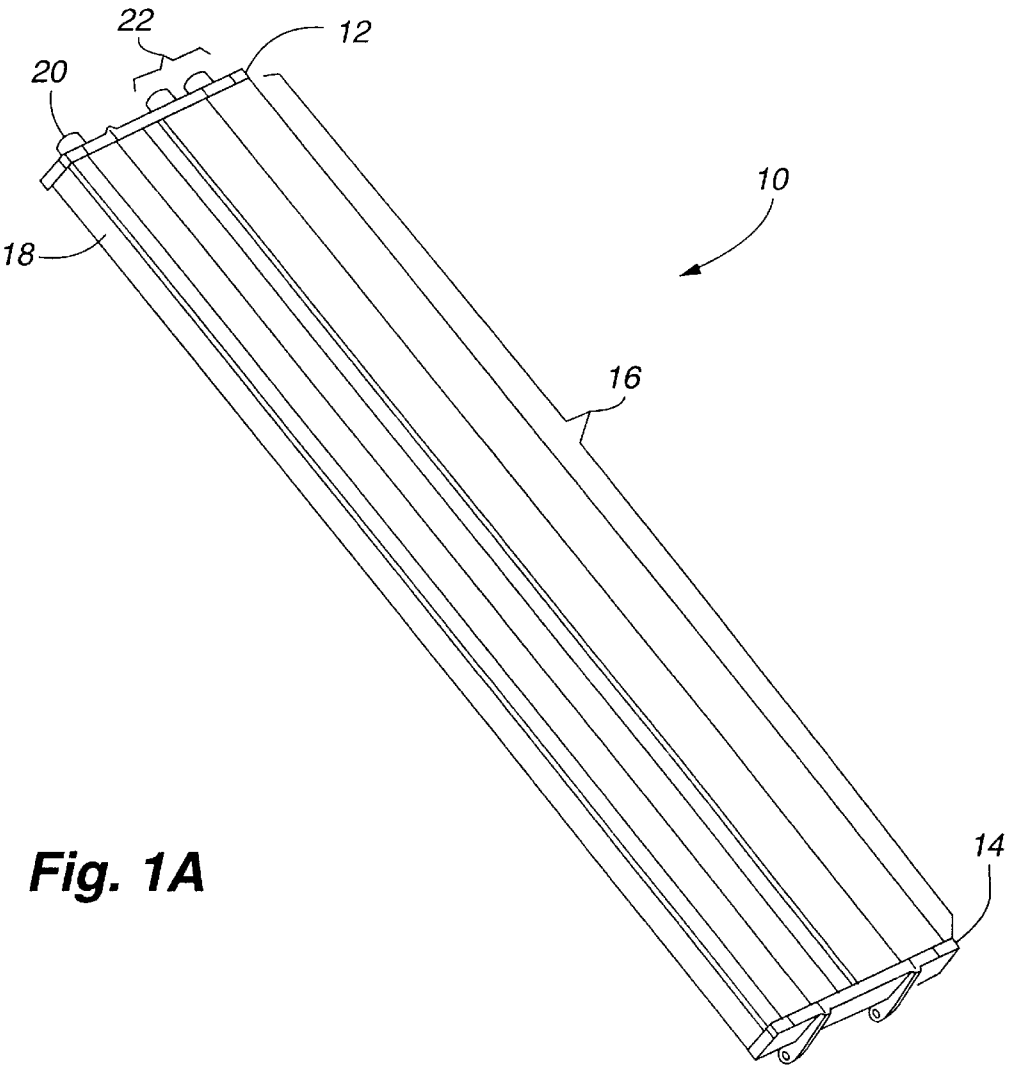
FIG. 1*a* is an isometric view of an antenna system in accordance with the present invention; the antenna system is covered by a radome to protect its internal circuitry.
Figure 1B:
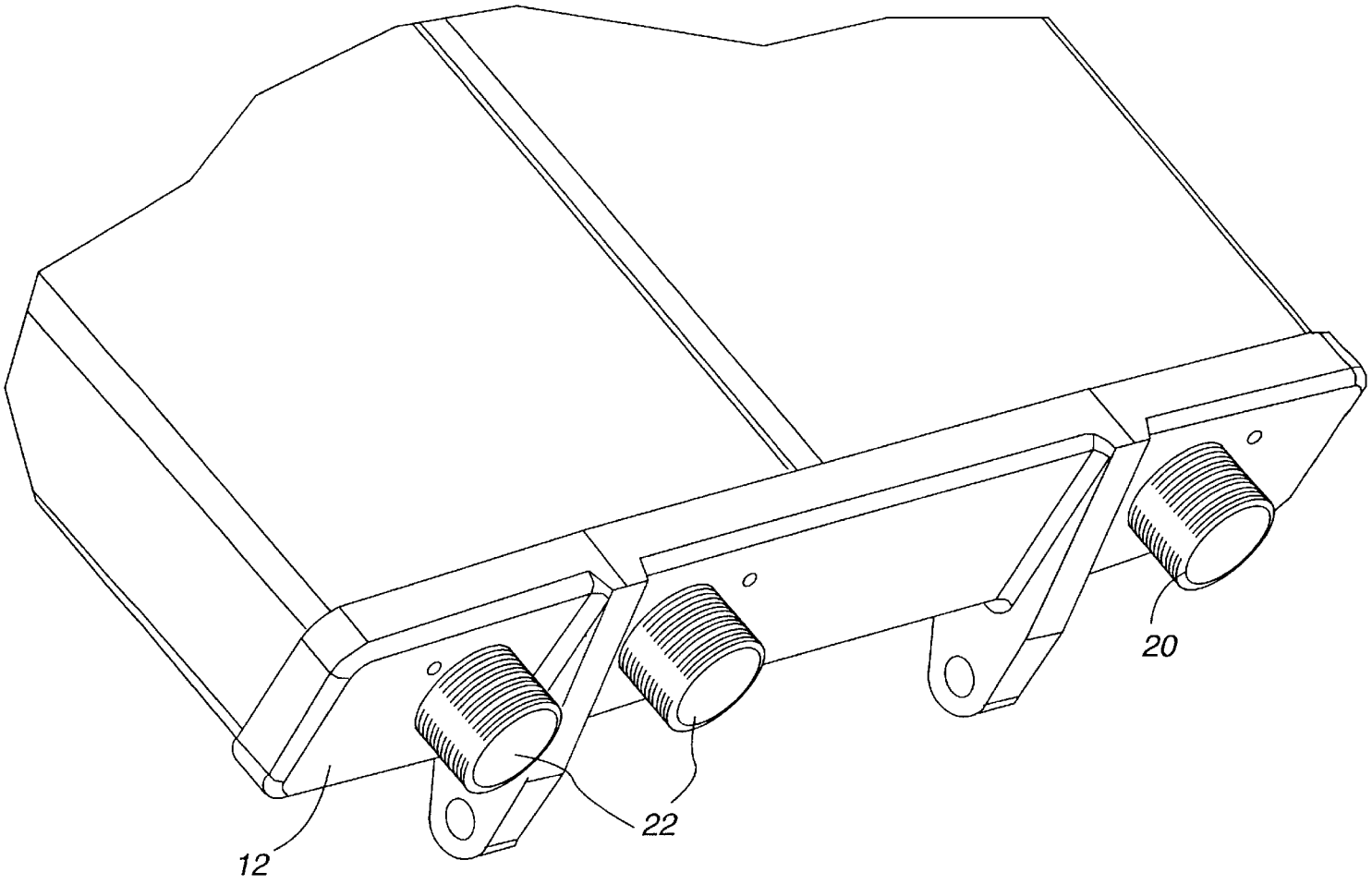
FIG. 1*b* is a close up view of an end flange of the antenna system of FIG. 1*a;*

FIG. 1*a* illustrates an antenna system 10 in accordance with the present invention. The antenna system 10 includes a pair of end flanges 12, 14 at either end of a body portion 16. During operation of the antenna system 10, the body portion 16 is surrounded by a radome 18 that protects the circuitry of the system 10 from the environment while being relatively transparent to the radio-frequency energy being transmitted/received by the antenna system 10. As illustrated in FIG. 1*b*, end flange 12 includes a plurality of connectors 20, 22 for use in coupling the antenna system 10 to transmit/receive (T/R) circuitry (not shown) external to the system 10. The T/R circuitry is operative for creating and delivering transmit signals to a transmit portion of the antenna system 10 and for accepting and processing receive signals from a receive portion of the antenna system 10.

Figure 2A:
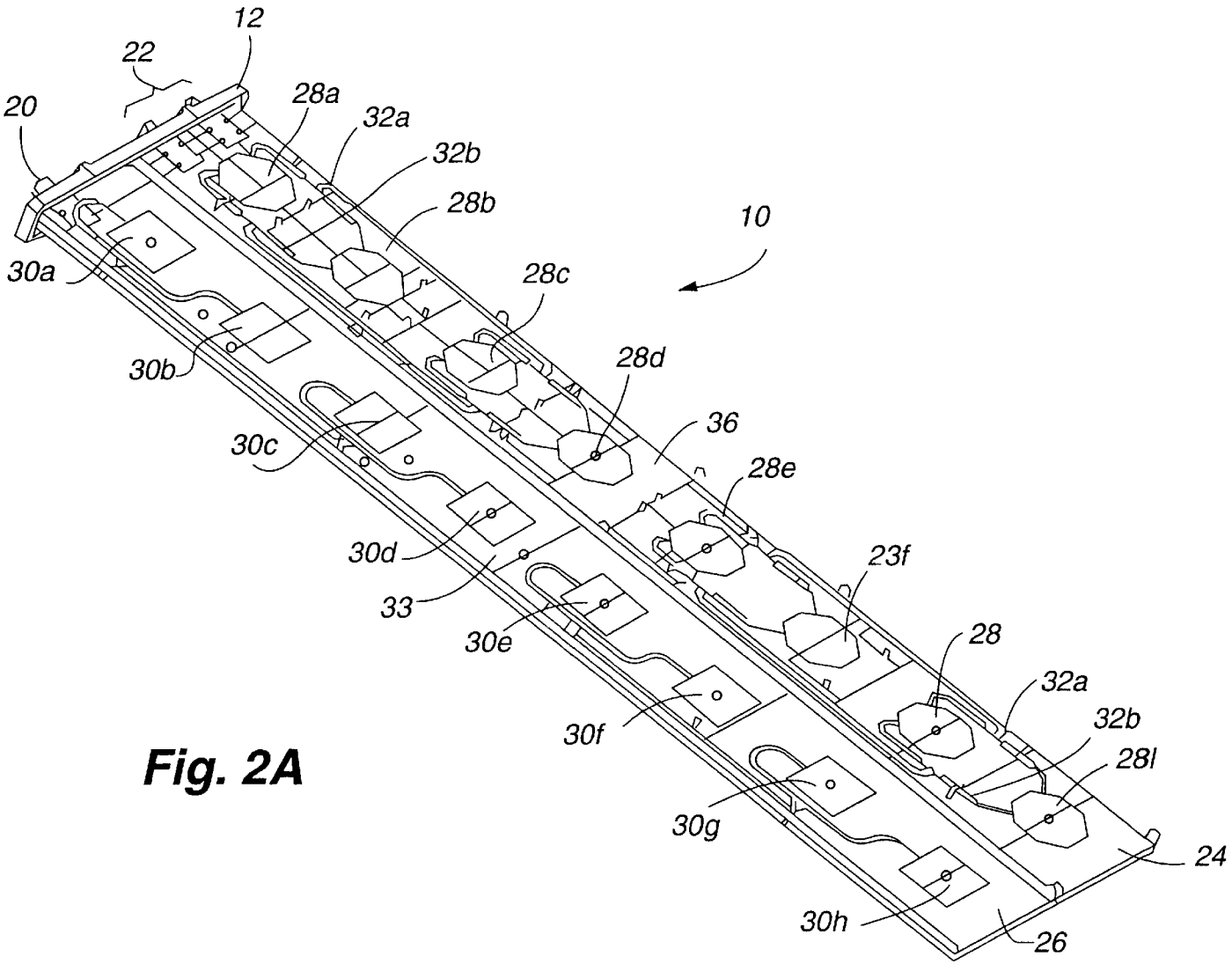
FIGS. 2*a* and 2*b* are an isometric view and a top view, respectively, of the antenna system of FIG. 1*a* with the radome removed.
Figure 2B:
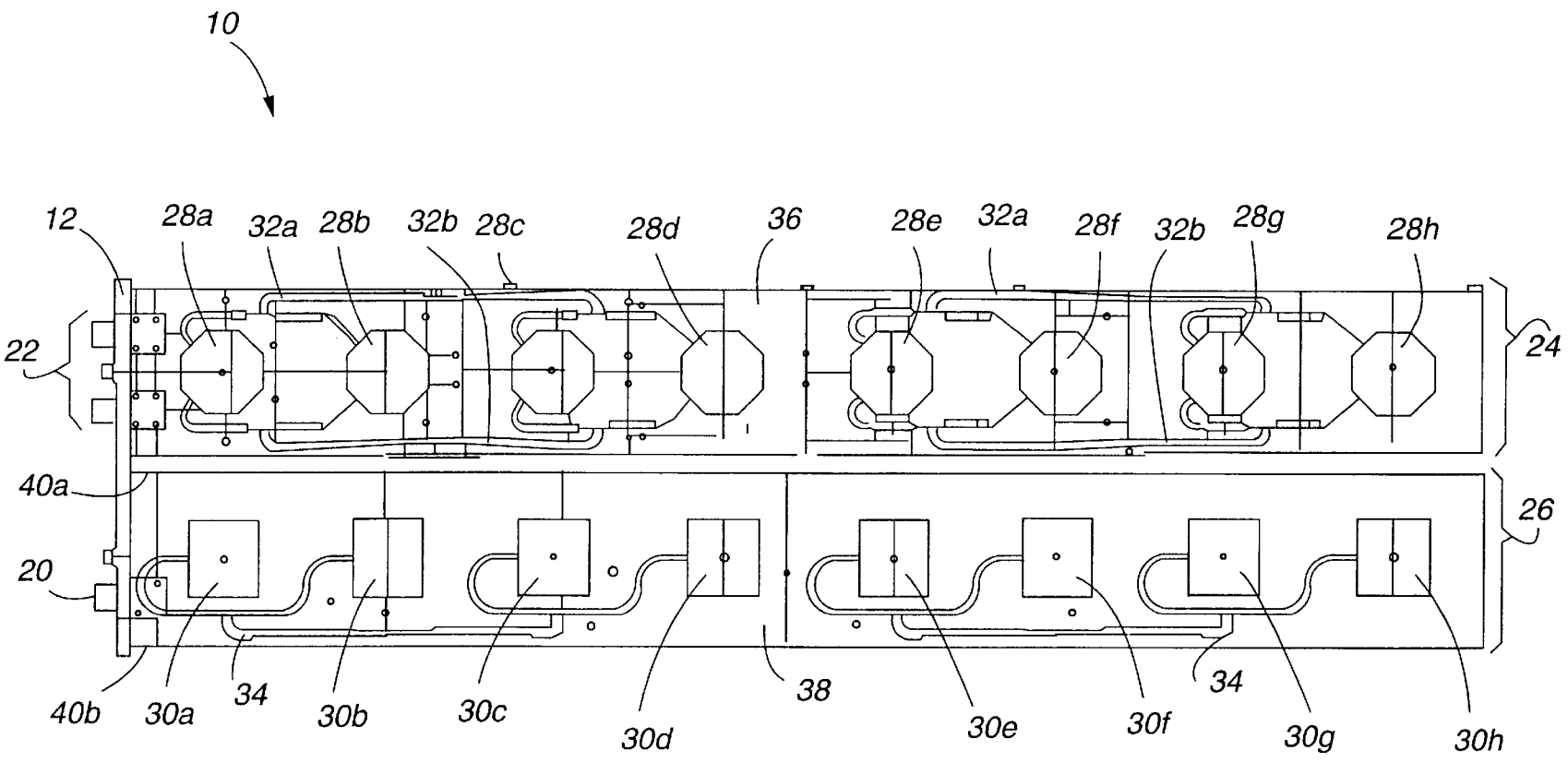

FIGS. 2*a* and 2*b* are an isometric view and a top view, respectively, of the antenna system 10 with the radome 18 and end flange 14 removed. In a preferred embodiment, the radome 18 and end flange 14 form an integrated assembly that slides on and off of the body portion 16 relatively easily. This easy on/off functionality simplifies assembly of the system 10 and facilitates servicing of the system 10 in the field.

As shown in FIGS. 2*a* and 2*b*, the antenna system 10 includes a receive array portion 24 and a transmit array portion 26. The receive array portion 24 includes a linear array of octagonal patch elements 28*a*–28*h* that operate in a dual slant 45 linearly-polarized mode. The receive array portion also includes feed structures 32*a*, 32*b* (partially shown) for delivering a receive signal from the elements 28*a*–28*h* to the receive connectors 22. The elements 28*a*–28*h* of the receive array, as well as portions of the feed structures 32*a*, 32*b*, are suspended above a conductive plate 36 that functions as a ground plane and provides structural rigidity to the antenna system 10. The feed structures 32*a*, 32*b* are comprised of transmission line portions, combiner portions and impedance matching structures.

The transmit array portion 26 includes a linear array of rectangular patch elements 30*a*–30*h* that operate in a linearly polarized/single pole mode. The transmit array portion 26 also includes a feed structure 34 (partially shown) for delivering a transmit signal from the transmit connector 20 to the transmit array elements 30*a*–30*h*. In this regard, the feed structure 34 includes transmission line sections, divider portions, and impedance matching structures. As with the receive array portion 24, the elements 30*a*–30*h* of the transmit array portion 26 are suspended above a conductive plate 38. The conductive plate 38 of the transmit array portion 26, however, is folded up at the sides to form walls 40*a*, 40*b* on the sides of the transmit array portion 26. The walls 40*a*, 40*b* serve to increase the isolation between the transmit array portion 26 and the receive array portion 24. Further isolation can also be achieved by adjusting the location of the transmit elements 30*a*–30*h* with respect to the receive elements 28*a*–28*h*. For example, with reference to FIG. 2*b*, the transmit array can be shifted to the right or left to increase isolation. The conductive plates 36 and 38 are electrically connected to one another and, in one embodiment, the ground surfaces of the two plates are located in substantially the same plane.

Figure 3A:
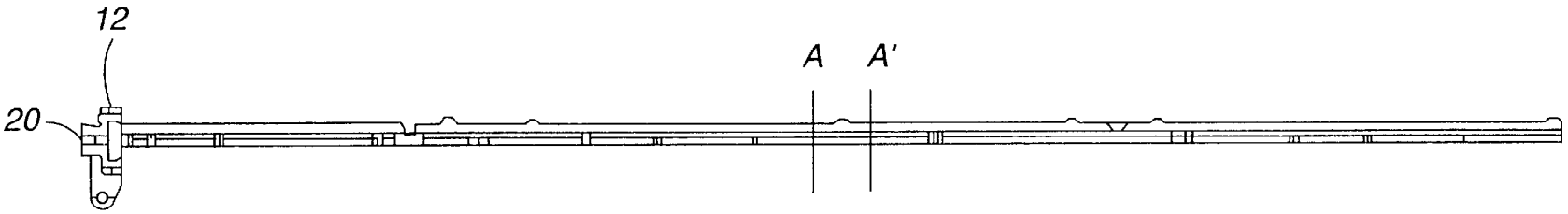
FIG. 3*a* is a side view of the antenna system of FIG. 1*a* with the radome removed, illustrating the multi-layer construction of the antenna system.
Figure 3B:
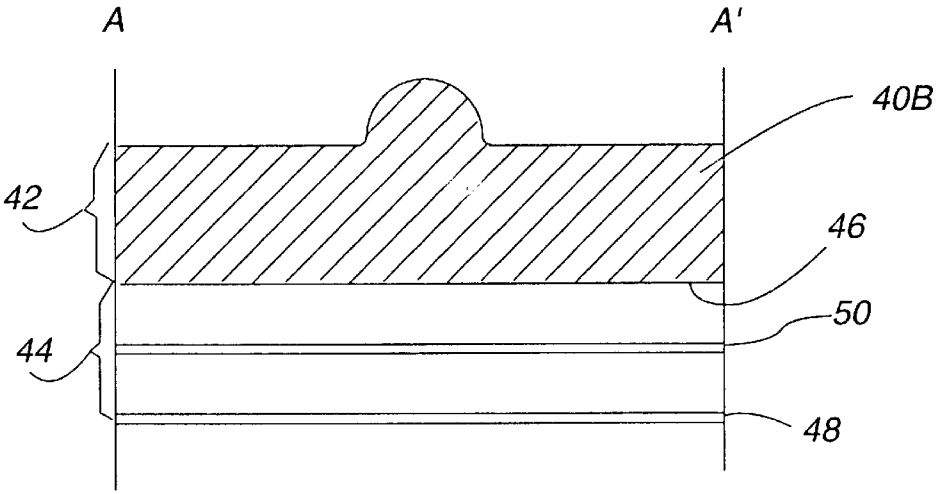
FIG. 3*b* is a blown up portion A–A' of FIG. 3*a* illustrating the multi-layer construction of the antenna system in more detail.

To make the antenna system 10 compact, a multi-layer feed arrangement is utilized. That is, a portion of each feed structure 32*a*, 32*b*, 34 is located on the same layer as the elements 28*a*–28*h*, 30*a*–30*h* and another portion is located on a different layer than the elements 28*a*–28*h*, 30*a*–30*h*. FIGS. 3*a* and 3*b* are side views of the system 10 showing the multi-layer construction, wherein FIG. 3*b* is a blown up portion A–A' of FIG. 3*a*. The system 10 has a two layer construction consisting of upper layer 42 and lower layer 44. As shown, the upper layer 42 includes wall 40*b* of conductive plate 38 of the transmit array portion 26. The upper layer 42 also includes (although not shown in FIGS. 3*a* and 3*b*) all of the antenna elements of the system 28*a*–28*h*, 30*a*–30*h* and upper portions of the feed structures 32*a*, 32*b*, 34. All of the transmission line sections in the upper portion 42 are in microstrip.

Figure 4:
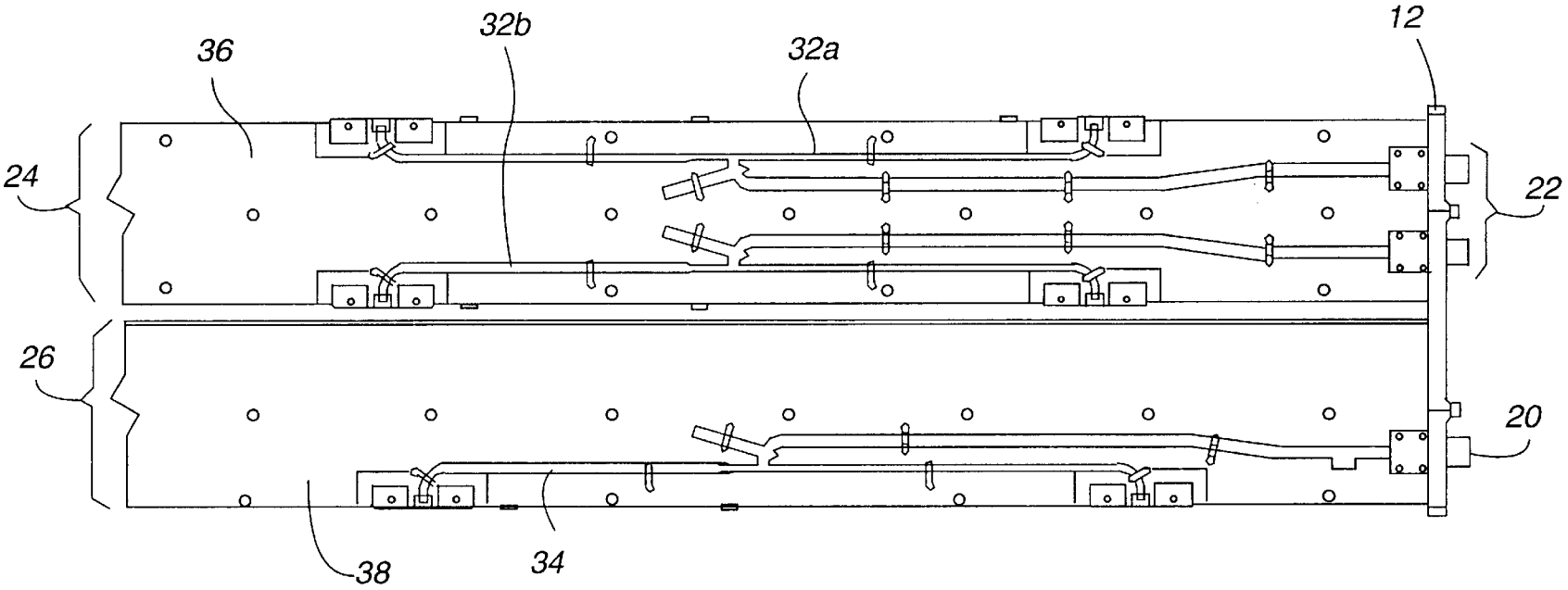
FIG. 4 is a bottom view of the antenna system of FIG. 1*a* with a lower ground plane removed illustrating portions of the feed circuitry of the antenna system.

The lower layer 44 includes, among other things, an upper ground plane 46, which is preferably the underside of conductive plate 38, a lower ground plane 48, and lower portions of the feed structures 32*a*, 32*b*, 34. FIG. 4 is a bottom view of the system 10, with the lower ground plane 48 removed, illustrating the feed structure portions on the lower layer 44. As illustrated, the lower layer 44 also includes circuitry for connecting the feed structures 32*a*, 32*b*, 34 to respective connectors 20, 22. Center conductor 50, which is suspended between upper ground plane 46 and lower ground plane 48, forms a stripline transmission line section on the lower layer 44 as part of the feed structure 34.

Figure 5:
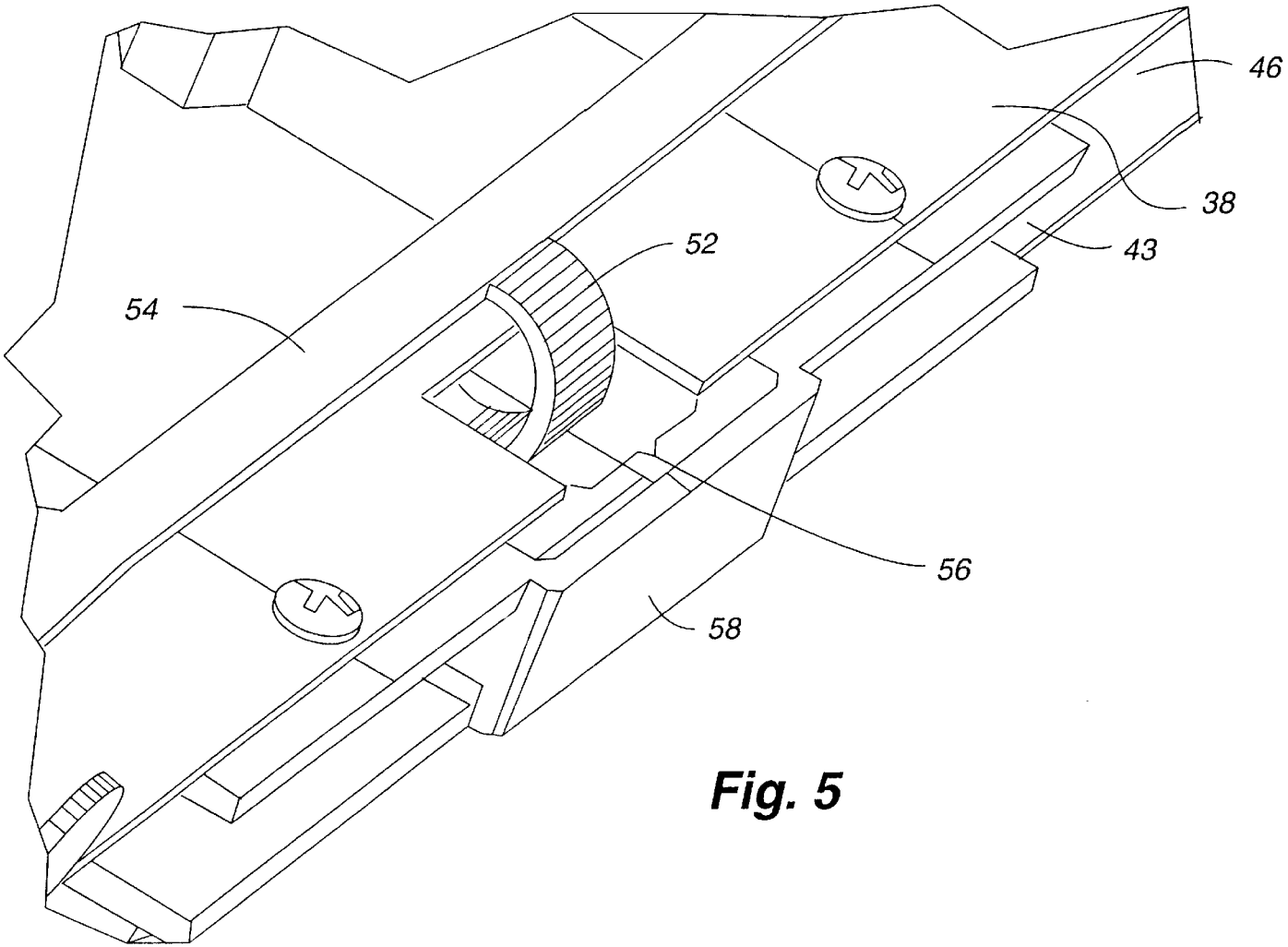
FIG. 5 is an isometric view of a transition for coupling transmission media on the upper and lower layers in accordance with the present invention.

FIG. 5 illustrates a wrap around transition 52 that is used to transfer signals between transmission structures on the upper layer 42 and transmission structures on the lower layer 44. The wrap around transition 52 is a shaped transmission line portion that carries a signal between a transmission line center conductor on the upper layer 42 and a transmission line center conductor on the lower layer 44. The shape of the wrap around transition 52 is preferably arcuate, although other shapes can also be used, such as those including right or acute angles. The width of the transition 52 is chosen to provide desired impedance characteristics so as to minimize mismatches at the junction points with the transmission line center conductors on the upper and lower layers.

In one embodiment, the wrap around transition 52 is integrally joined to the transmission line center conductors on the upper and lower layers. That is, all three elements are formed together as a single piece, such as by stamping. The transition 52 is later shaped by appropriate means before the entire assembly is installed into the antenna housing. By forming the transition 52 as a single piece with the transmission structures, no metal to metal contact points are created that can result in passive intermodulation problems. As described above, it is very important that passive intermod creation be held to a minimum in communications applications.

As illustrated in FIG. 5, a notch 56 is made in the conductive plate 38 to make room for the transition 52. The dimensions of the notch 56 are chosen so that the characteristic impedance of the transmission line is maintained and radiation and mode generation are minimized. A transition, such as the one illustrated in FIG. 5, can be used to transfer radio frequency signals from one transmission medium to another using any one of several combinations. For example, the transition can be between two microstrip media on different layers, between two stripline media on different layers, or, as in the illustrated embodiment, between a microstrip medium on one layer and a stripline medium on another layer.

Figure 6A:
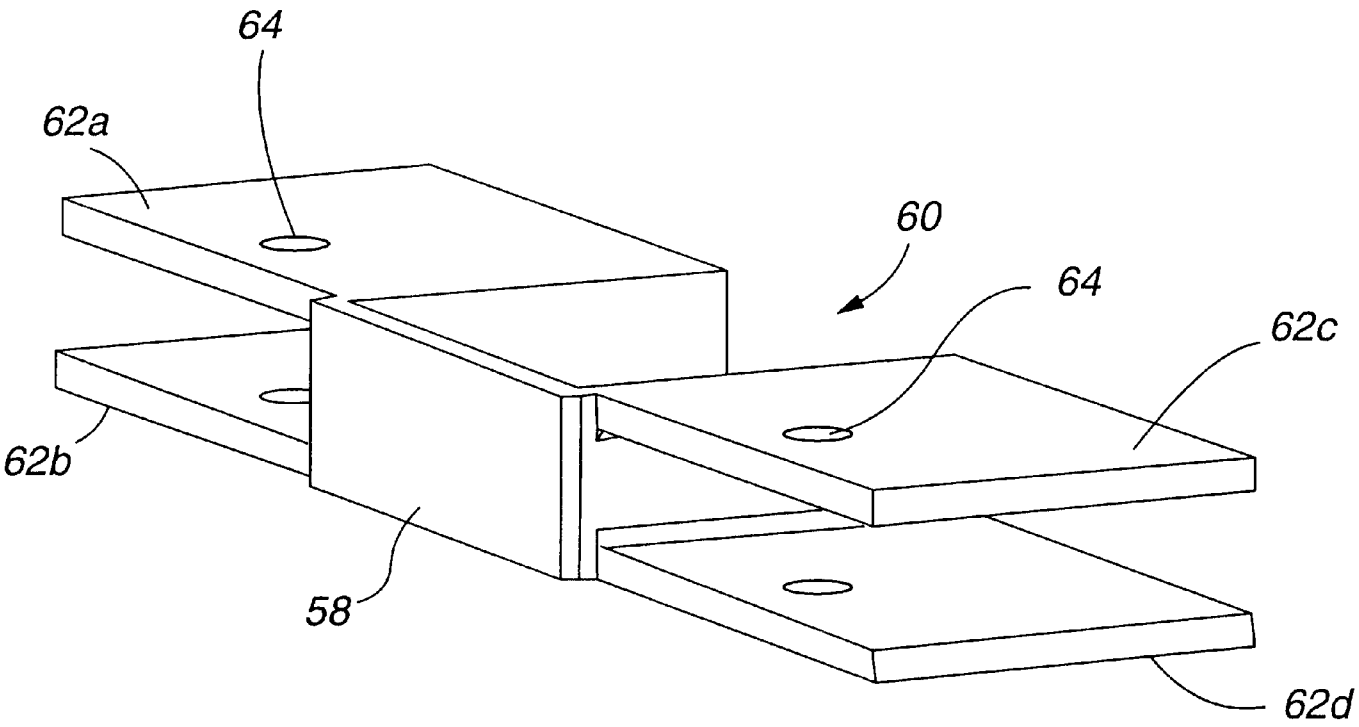
FIGS. 6*a*, 6*b*, and 6*c* are an isometric view, a top view, and a side view, respectively, of a mode suppressor in accordance with the present invention.
Figure 6B:
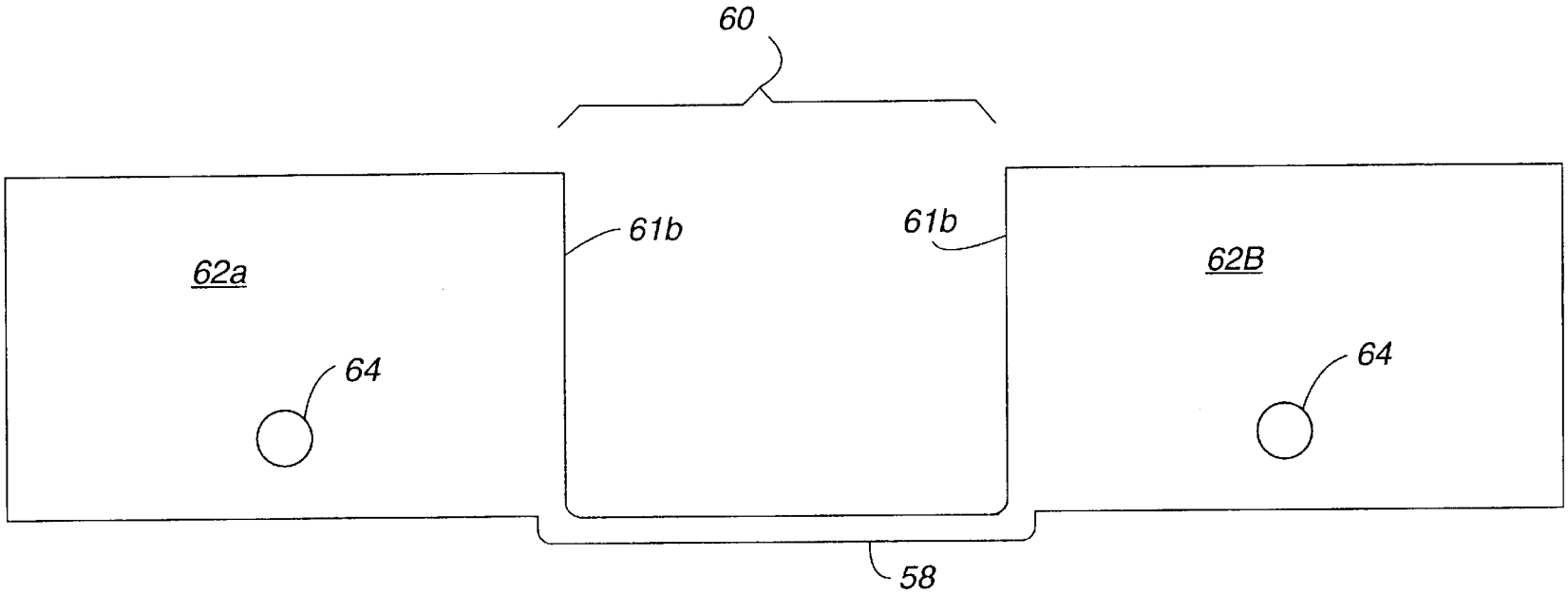
Figure 6C:
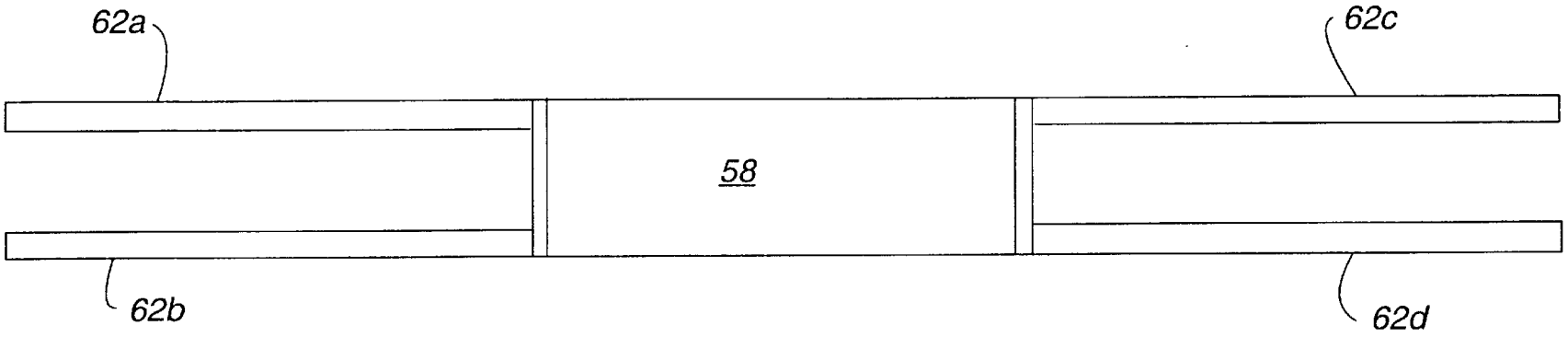

To prevent the creation of undesired parallel plate transmission modes, or other undesired modes, near the transition 52 or on the lower layer 44, a mode suppressor 58 is located between the upper ground plane 46 and the lower ground plane 48, in the vicinity of the transition 52. FIGS. 6*a*–6*c* illustrate the mode suppressor 58 removed from the system 10. The mode suppressor 58 includes a walled area 60 that, when installed, substantially surrounds the portion of the transition 52 that is located in the lower layer 44, on three sides. In a preferred embodiment, the dimensions of the walled area 60 are chosen so that the length of each side wall 61*a*, 61*b* is approximately two times the spacing between the ground planes 46, 48. In addition, the side walls 61*a*, 61*b* of the walled area 60 in this embodiment extend inward past an endpoint on the transition 52 by a distance that is greater than or equal to the spacing between the ground planes. The walled area 60 must be wide enough to provide an acceptable characteristic impedance for the transition 52 and so that precise placement of the transition 52 is not necessary. The walled area 60 can be any number of different shapes, such as rectangular (as illustrated in FIGS. 6*a*–6*c*) or curved, as long as the transition 52 is adequately surrounded.

To properly suppress undesired modes, the mode suppressor 58 must be grounded (i.e., the mode suppressor must be adequately coupled to the ground planes 46, 48). One way to provide this ground is to directly contact the mode suppressor body to the upper ground plane 46 and the lower ground plane 48. Because the mode suppressor 58 is operative in a high current area, however, this direct contact approach can create passive intermodulation problems as described previously. In accordance with one embodiment of the present invention, the mode suppressor 58 is capacitively coupled to the upper and lower ground planes 46, 48 to create an RF short between the mode suppressor 58 and ground without the need for metal to metal contact.

In one embodiment, as illustrated in FIGS. 6*a*–6*c*, relatively wide flanges 62*a*–62*d* are provided on the mode suppressor 58 for creating the capacitive coupling to ground. That is, a suitable dielectric material is interposed between each of the flanges 62*a*–62*d* and the corresponding ground plane 46, 48 for creating a capacitance therebetween. The surface area of each flange 62*a*–62*d* and the dielectric constant and thickness of the dielectric material are chosen to achieve a capacitance that provides substantially a short circuit between the mode suppressor and ground at the frequency of interest. The dielectric material can include an insulative tape that is applied to the mode suppressor and/or the ground planes; a coating on the mode suppressor and/or the ground plane such as, for example, a sprayed-on coating or an anodized layer; or a dielectric sheet material that is laid between the mode suppressor 58 and the ground planes 46, 48 during assembly. Other low loss dielectric materials, such as air or teflon, can also be used.

Figure 7:
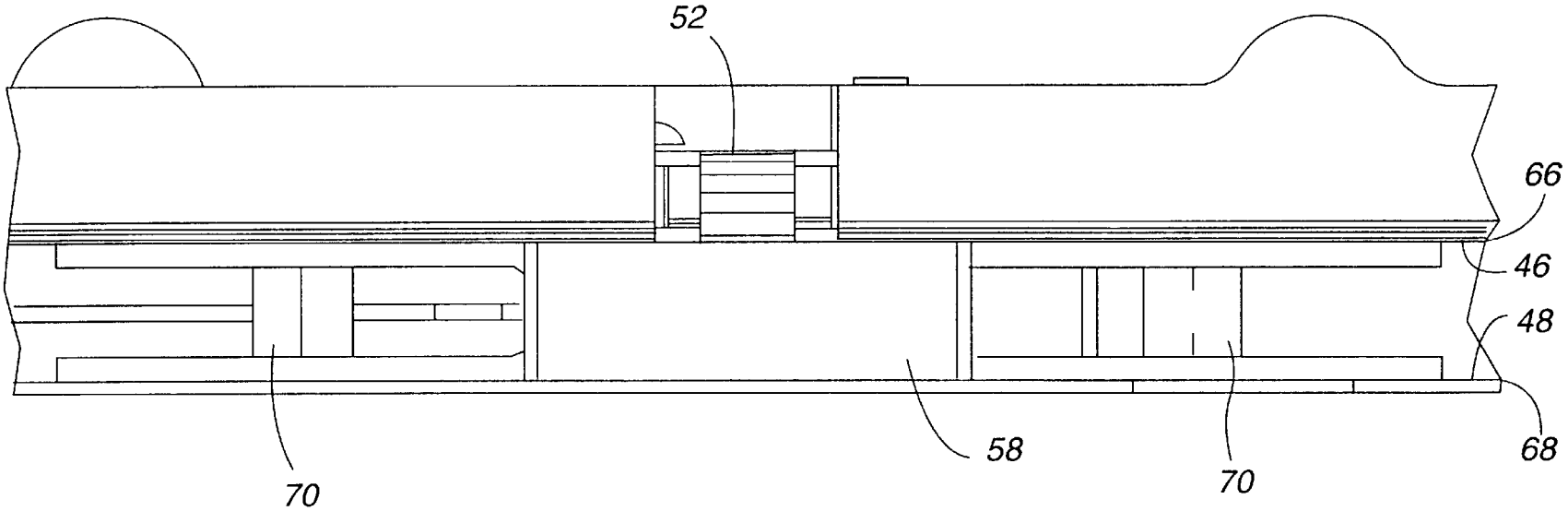
FIG. 7 is a side view of the antenna system of FIG. 1*a* with the radome removed, illustrating the positioning of the mode suppressor of FIGS. 6*a*, 6*b*, and 6*c* between an upper and lower ground plane with a dielectric layer separating the mode suppressor from the ground planes.

FIG. 7 illustrates the mode suppressor 58 installed between the upper and lower ground planes 46, 48 with dielectric layers 66, 68 between the mode suppressor 58 and the ground planes 46, 48. The mode suppressor 58 is secured in place using screws, or other suitable fastening means. For example, a screw can be placed through clearance holes in the upper ground plane 46, the upper and lower flanges 62*a*, 62*b* of the mode suppressor 58, and the lower ground plane 48 and secured with a fastener on the lower side. Alternatively, the fastening method used can be integrated into the mode suppressor 58 through injection molding or other methods. For example, an injection molded snap that allows the mode suppressor 58 to be snapped in place between the ground planes 46, 48 can be provided. In another alternative embodiment, the mode suppressor 58 can be an integral part of the ground plane design, thereby eliminating the need for a separate unit. For example, the walls of the mode suppressor 58 can comprise bent portions of the upper and/or lower ground planes 46, 48.

If metallic fasteners are utilized, care must be taken to avoid metal to metal contact that can result in the creation of passive intermodulation components. One way to do this is to provide clearance holes 64 of suitable diameter in the flanges 68*a*–68*d* of the mode suppressor 58 so that the fasteners never contact the flanges. These clearance holes 64 can be lined with a dielectric material to further isolate them electrically from the fasteners. In addition, dielectric washers or bushings can be provided for preventing electrical contact between the fasteners and the ground planes 46, 48. Other insulating techniques can also be used.

In the illustrated embodiment, spacers 70 are provided for preventing compression of the mode suppressor flanges 62*a*–62*d* as this compression can significantly change the characteristic impedance in the vicinity of the spacer 70 and/or significantly change the capacitance between the flanges 62*a*–62*d* and the ground planes 46, 48 and thus reduce the effectiveness of the mode suppressor 58 and the transition 52. The spacers 70 can be separate units or integral to the mode suppressor 58. Alternatively, the flanges 62*a*–62*d* of the mode suppressor 58 can be solid from top to bottom so that compression is avoided.

Figure 8A:
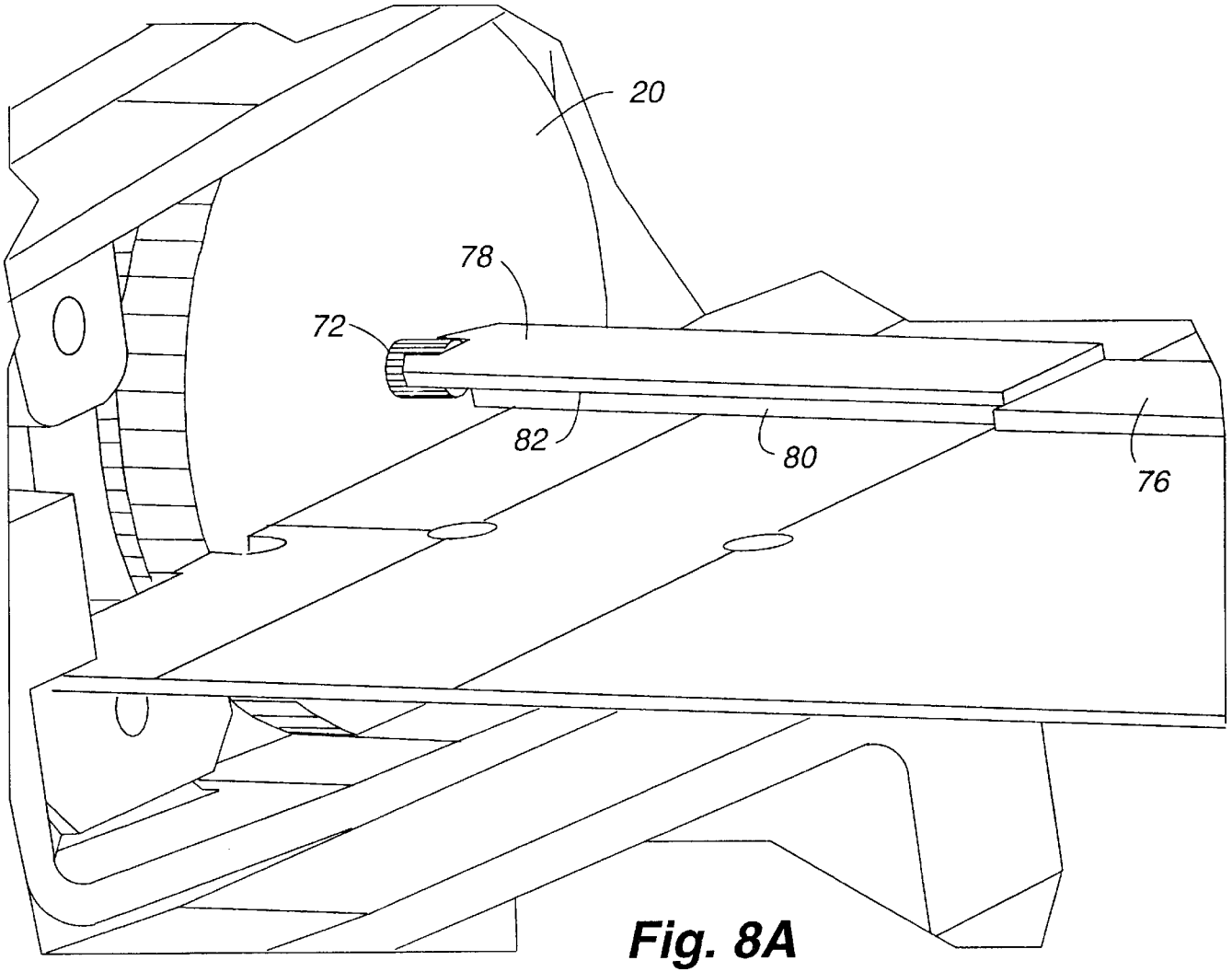
FIGS. 8*a* and 8*b* are an isometric view and a side view, respectively, illustrating the interconnection between a connector center conductor and a transmission line center conductor in accordance with the present invention.

FIG. 8*a* is an isometric view illustrating the interconnection between the center conductor 72 of transmit connector 20 and transmission line center conductor 76 of transmit feed structure 34. A similar interconnection method is used between the center conductors of receive connectors 22 and transmission line center conductors within receive feed structure 32. As in other portions of the system 10, the method of interconnecting the connector center conductor 72 to the transmission line center conductor 76 avoids the creation of metal to metal contact, and hence the creation of intermodulation products, by using capacitive coupling. For example, as seen in FIG. 8*a*, a first conductive strip 78, that is conductively coupled to the connector center conductor 72, is situated above a second conductive strip 80, that is an extension of transmission line center conductor 76, with a dielectric layer 82 disposed therebetween. The surface area of the first and second conductive strips 78, 80 and the type and thickness of the dielectric comprising dielectric layer 82 determine the capacitance between the conductive strips 78, 80. In general, the capacitance required between the conductive strips 78, 80 must be enough to create substantially an RF short circuit at the frequency of interest. That is, the reactance formed by the capacitor should not exceed a relatively low value, such as approximately 0.05 ohms, at the frequency of interest.

In a preferred embodiment, conductive strip 78 forms a single piece with connector center conductor 72, such that no metal to metal contact is made at the junction. That is, the connector center conductor 72 and the conductive strip 78 are formed from the same piece of metal and assembled into the connected 20 by the connector manufacturer. Alternatively, the conductive strip 78 can be attached to the connector center conductor 72 by other means, such as by welding, after manufacture of the connector 20.

It is very important that moisture is not allowed to collect between conductive strip 78 and conductive strip 80. This could significantly change the capacitance between the two conductive strips, thereby creating undesired mismatches at the input to the antenna system 10. To avoid moisture collection, and to provide support to the junction, a shrink wrap covering is placed around the junction between the strips 78, 80. In one embodiment, a shrink wrap having an inner adhesive lining is used to provide an enhanced moisture seal at the junction. The shrink wrap covering can be extended to cover the area where conductive strip 78 joins with connector center conductor 72. The covering can also be extended in the other direction to cover a significant portion of transmission line center conductor 76.

Figure 8B:
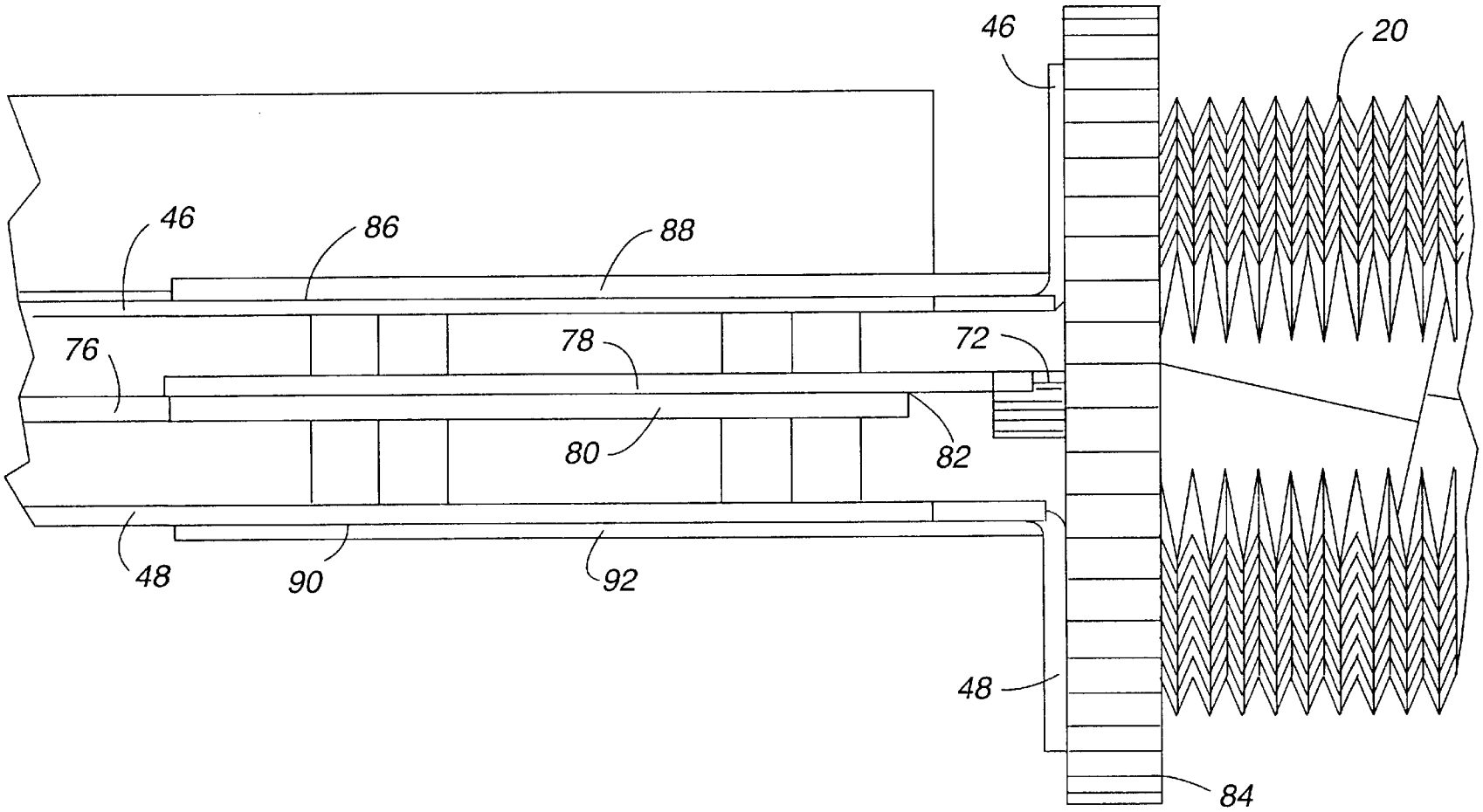

FIG. 8*b* is a side view illustrating the interconnection between connector center conductor 72 and transmission line center conductor 76. FIG. 8*b* also illustrates the interconnection between flange 84 of connector 20 and upper and lower ground planes 46, 48 of lower layer 44. Because this is a high current area, metal to metal contact should be avoided when connecting the connector flange 84 to the ground planes 46, 48. In this regard, a capacitive coupling is implemented in this area. First, flange extension plates 88, 92 are provided that extend the flange in the direction of the upper and lower ground planes 46, 48. These flange extension plates 88, 92 are substantially parallel to the ground planes 46, 48 and are separated by a distance that allows them to fit closely around the ground planes. The flange extension plates 88, 92 are preferably formed from a single piece of metal with the connector flange 84 to avoid metal to metal contact. However, they can also be welded or soldered to the connector flange 84. To provide capacitive coupling, a dielectric layer 86 is interposed between extension plate 88 and upper ground plane 46 and a dielectric layer 90 is interposed between extension plate 92 and lower ground plane 48.

Figure 9A:
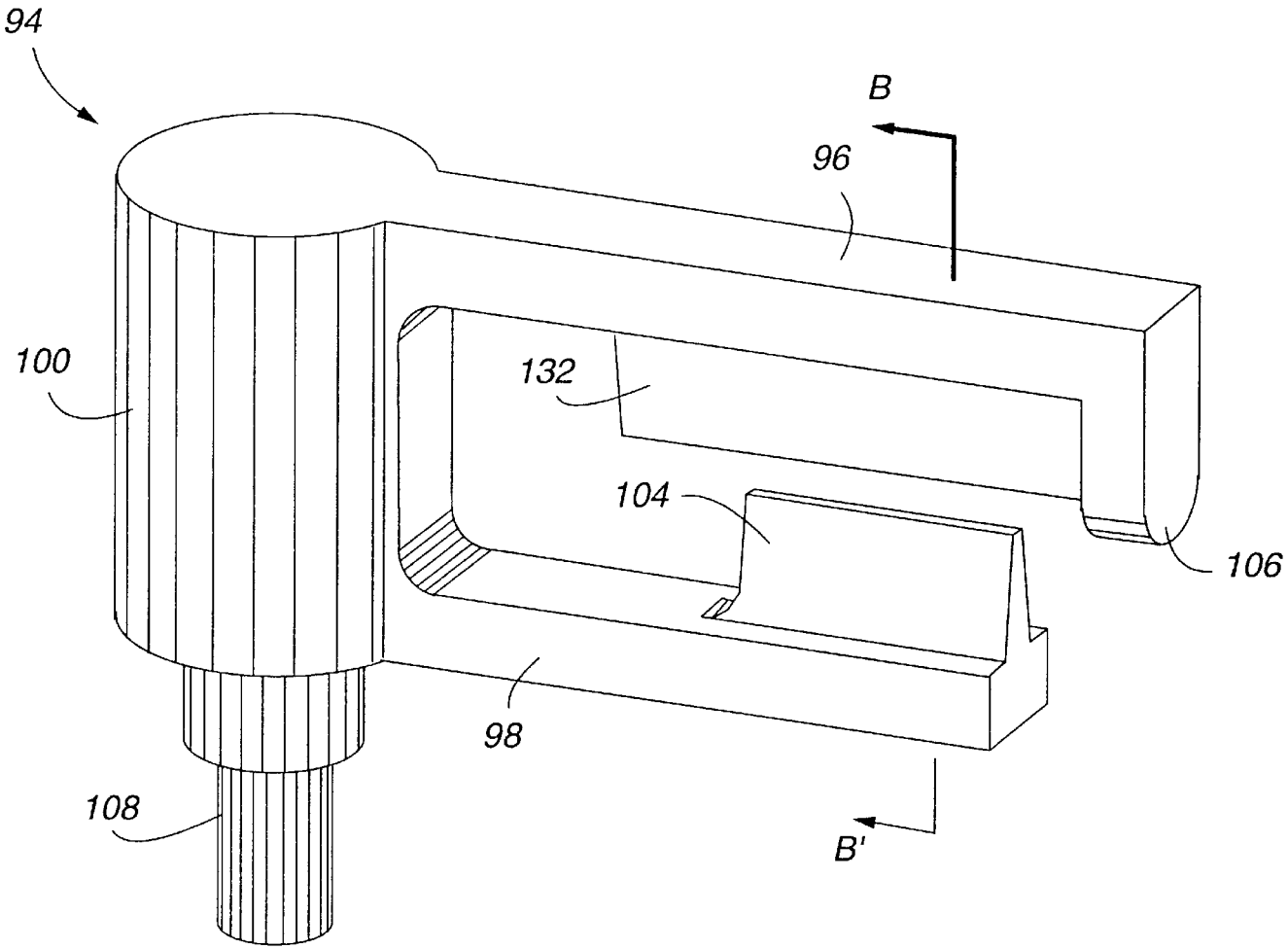

FIGS. 9A and 9B illustrate a retainer 94 for use in suspending the feed structures 32*a*, 32*b*, 34 above their respective conductive plates 36, 38. The retainer 94 includes an upper arm 96 and a lower arm 98 that extend radially from a body 100. The upper arm 96 and the lower arm 98 each include a retaining fin 102, 104 for use in holding a transmission line center conductor, or other circuitry, at a proper layer above an associated ground plane. To reduce dielectric loading on the transmission line, retaining fins 102, 104 are tapered so that the portion that contacts the transmission line center conductor comprises very little dielectric material while the wider portion increases the strength and rigidity of the fin. FIG. 9*b* is a sectional view illustrating the tapered cross section of the retaining fins 102, 104. Because the contact area between the retaining fins 102, 104 and the transmission line center conductor is very small, very little moisture can accumulate at the junction. This is important as moisture can significantly affect the characteristic impedance of the transmission line. The retainer 94 also includes a retaining lip 106 for preventing a transmission line semi-conductor from sliding laterally outward from between retaining fins 102 and 104.

To secure the retainer 94 to a base plate, fastening means 108 is provided. In a preferred embodiment of the invention, fastening means 108 comprises a compression snap that is pressed into a proper receptacle in the base plate. However, fastening means 108 can include virtually any type of fastening means, such as, for example, a screw that can be screwed into a tapped hole in the base plate.

As is apparent, retainer 94 should be constructed of a dielectric material having relatively low loss. The dielectric material should be relatively rigid so that upper and lower arms 96, 98 can provide adequate support to the transmission line center conductor being held. In addition, the material used should not be moisture absorbing, as this can change the dielectric loss characteristics of the material significantly. In one embodiment of the invention, a nylon glass material is used. Materials such as acetal, nylon 66, and polyethylene, for example, can also be used.

Figure 10A:
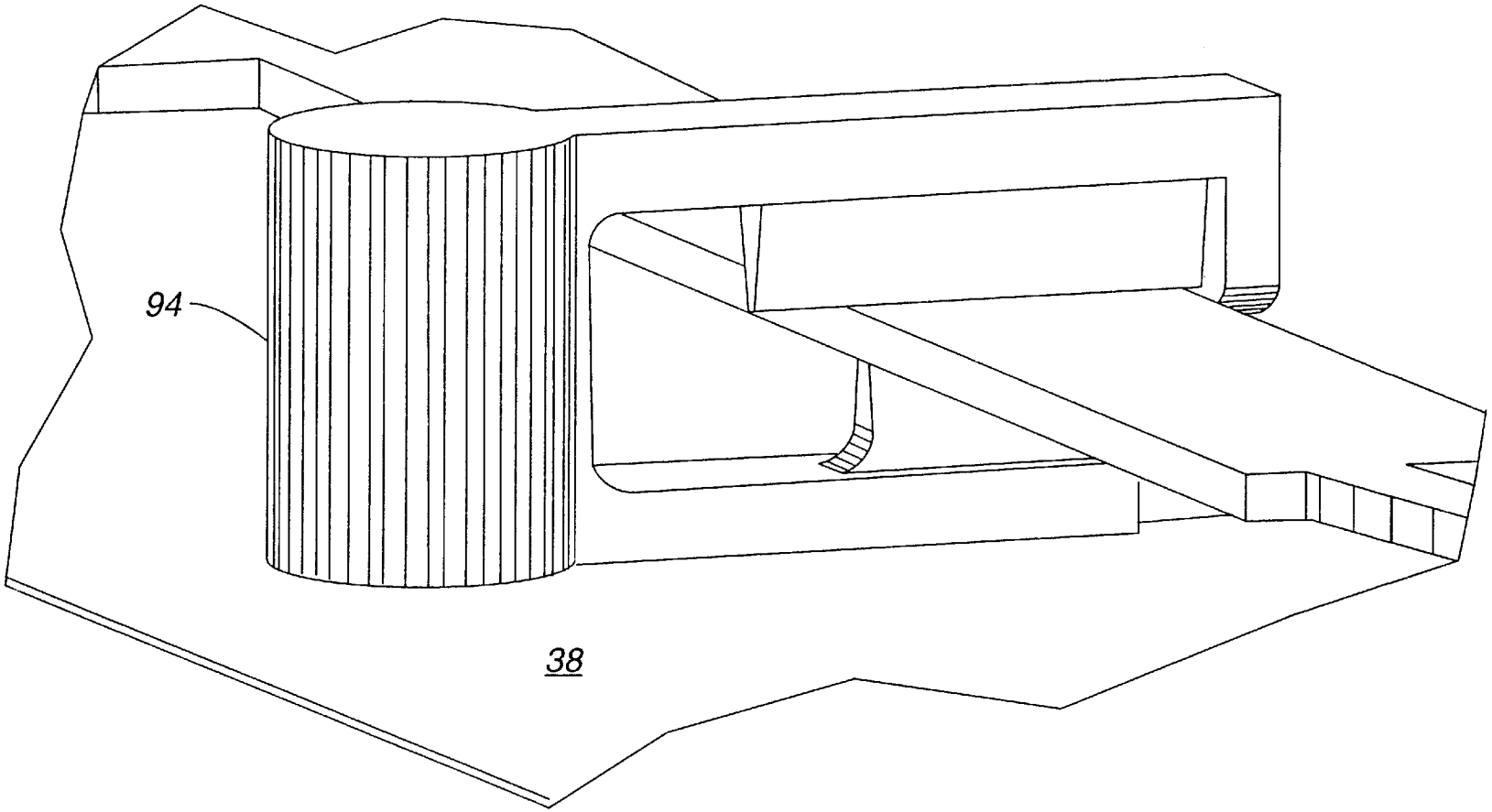
FIGS. 10*a* and 10*b* illustrate the retainer of FIGS. 9*a* and 9*b* holding a transmission line center conductor.
Figure 10B:
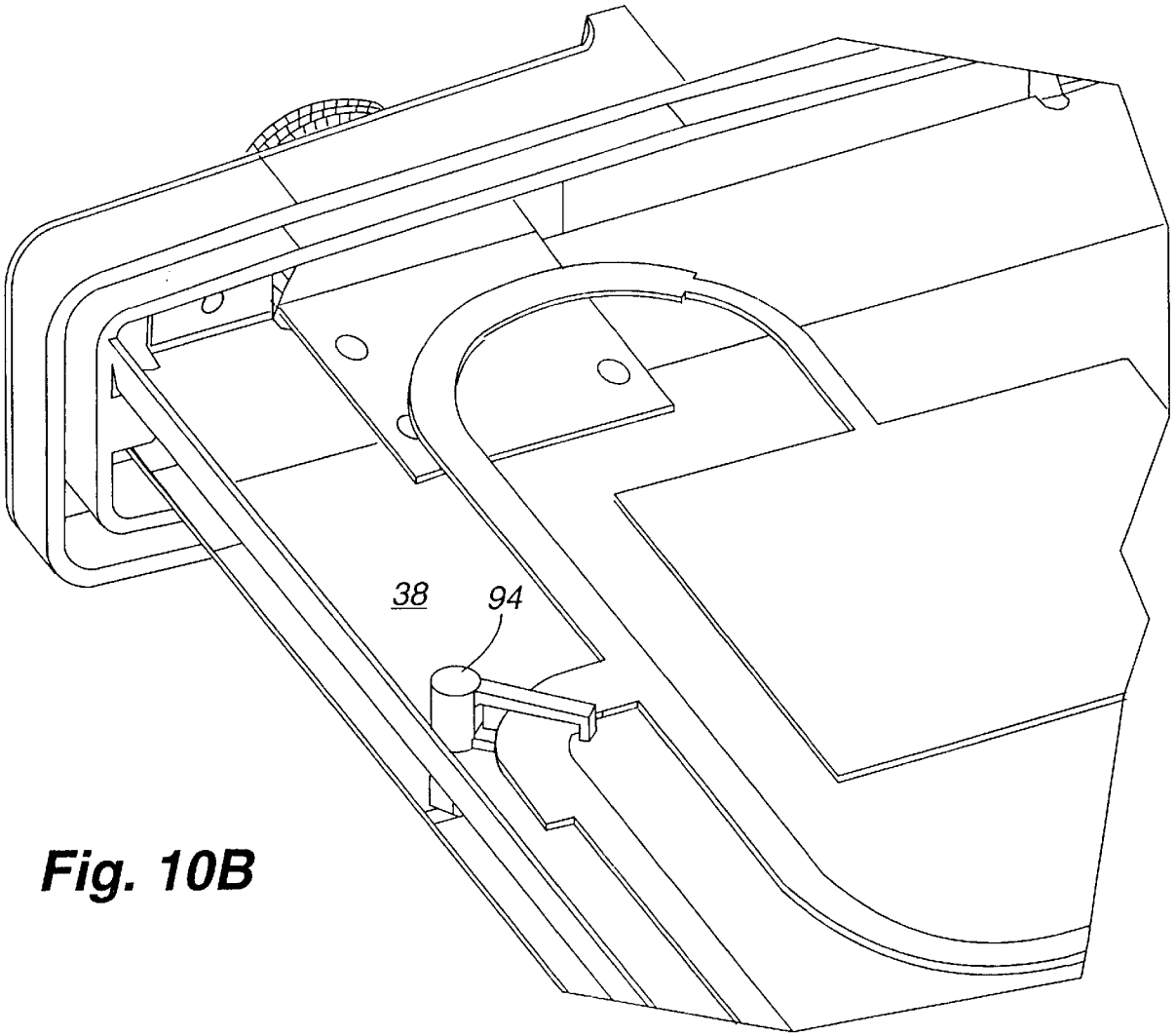

Because the retainer 94 of the present invention creates very little dielectric loading on the transmission line it is holding, relatively little reflection is created at the portion of the transmission line being held. In addition, because reflections are so small, retainers do not need to be periodically placed along the transmission line to cancel mismatch effects. This significantly reduces the number of retainers that are needed to support the transmission line and correspondingly reduces the overall weight of and losses in the antenna system 10. The retainer 94 can also be used to support the feed structures on the lower layer 44 so that these feed structures are at the proper position between the upper and lower ground planes 46, 48. When used on the lower layer, the retainers can include fastening means on both the top and the bottom of retainer body 100. FIGS. 10A and 10B are two views of a retainer 94 secured to a conductive plate 38 and holding a transmission line center conductor.

Figure 11:
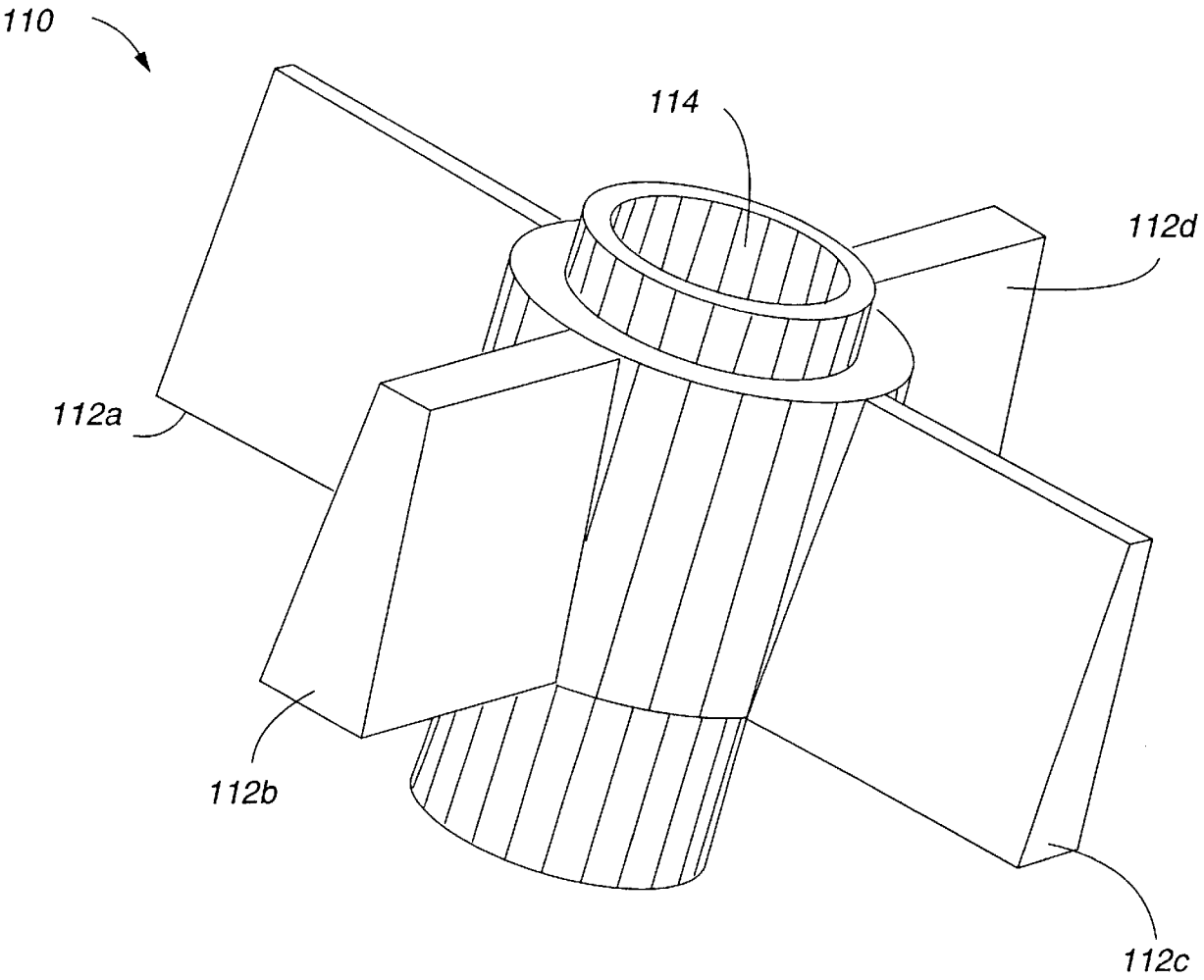
FIG. 11 illustrates a spacer that is used to suspend a radiating element above a ground plane in accordance with the present invention.

FIG. 11 illustrates a spacer 110 that is used to suspend the radiating elements 28*a*–28*h*, 30*a*–30*h* above their respective conductive plates 36, 38. The spacer 110 includes four radially extending arms 112*a*–112*d* that provide most of the support to the radiating element. The arms 112*a*–112*d* have a tapered structure much like that of the retaining fins 102, 104 of the retainer 94. This tapered structure reduces the dielectric loading on the radiating element and also prevents a collection of moisture between the spacer 110 and the radiating element that can adversely affect operation. The spacer 110 should be made of a similar dielectric material to that of the retainer 94. In the illustrated embodiment, a clearance hole 114 is provided in the spacer 110 for use in securing the spacer between the radiating element and the associated conductive plate. That is, a screw, or other fastening means, is inserted through a hole in the radiating element and through hole 114 of spacer 110 after which it is secured to the underlying base plate or other structure. It should be appreciated that other fastening methods can be utilized for securing the spacer 110 in the proper position between the radiating element and the corresponding conductive plate without departing from the spirit and scope of the invention. For example, the spacer 110 can be molded with two threaded posts, one on the top and one on the bottom, for use in securing the spacer 110 in position. The posts are placed through the holes in the radiating element and the base plate and a fastener is secured to the end.

Figure 12A:
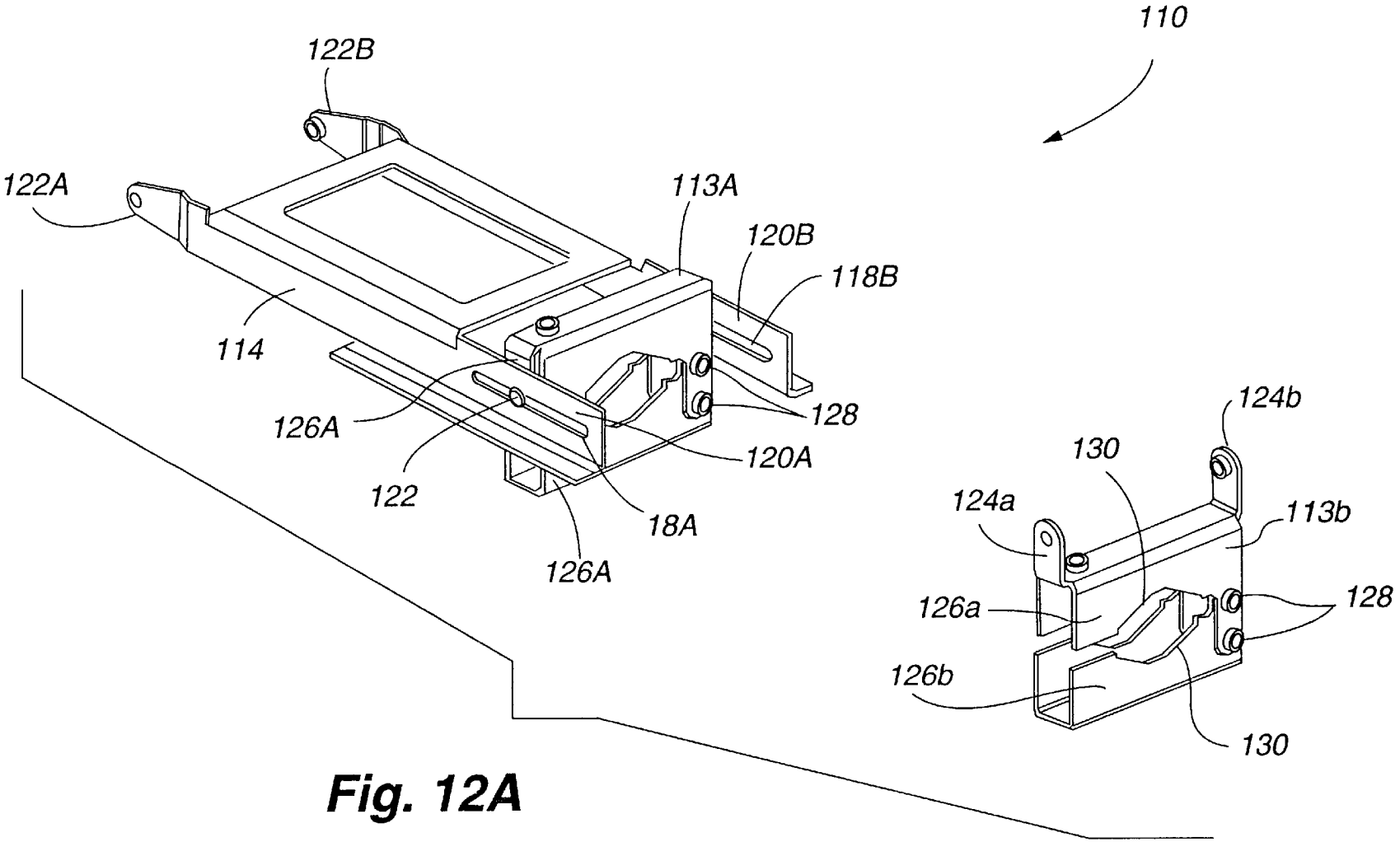
FIGS. 12*a* and 12*b* illustrate a bracketing system that is used to mount the antenna system of FIG. 1 to a pole in accordance with the present invention.

FIG. 12*a* illustrates a bracketing system 110 that is used to mount the antenna system 10 to a pole. The bracketing system 110 includes a pair of clam-shell type clamps, i.e., upper clamp 113*a* and lower clamp 113*b*, for attachment to the pole. The bracketing system 110 also includes a brace 114 that, when installed, is connected between the upper clamp 113*a* and the end flange 14 of the antenna system 10. The brace 114 is used in adjusting the angle of the antenna system 10 with respect to the pole. The brace 114 includes a pair of slots 118*a*, 118*b* machined into side flanges 120*a*, 120*b* at one end of the brace 114. The slots 118*a*, 118*b* ride along bolts 122 secured to ears/flanges on the upper clamp 113*a*. The bolts 122 can be tightened to fix the position of the brace 114 with respect to the upper clamp 113*a*. Both the brace 114 and the lower clamp 113*b* include flanges 122*a*, 122*b* and 124*a*, 124*b* for use in pivotally connecting each unit to the antenna system 10.

The clamps 113*a*, 113*b* each have a special adjustable hinge mechanism that allows the clamp to be attached to poles of varying diameter. For example, one embodiment of the clamp is capable of being attached to poles having diameters ranging from two to four inches. To accommodate varying pole diameters, each clamp 113*a*, 113*b* is comprised of a first and second jaw member 126*a*, 126*b*. The first jaw member 126*a* has a plurality of hub locations 128 to which the second jaw member can be attached. Adjustment for pole diameter is accomplished by attaching the second jaw member 126*b* to the appropriate hub location 128 on the first jaw member 126*a*. To secure one of the clamps 113*a*, 113*b* to the pole, the hinge mechanism is first appropriately adjusted for the pole and then the clamp is placed around the pole at the appropriate location. A bolt is then placed through a clearance hole in the first jaw member 126*a* of the clamp and is secured to a lock nut welded onto the second jaw member of the clamp. Teeth 130 are provided on the contact surfaces of the first and second jaw members 126*a*, 126*b* to prevent slippage of the clamp on the pole once secured in place.

Figure 12B:
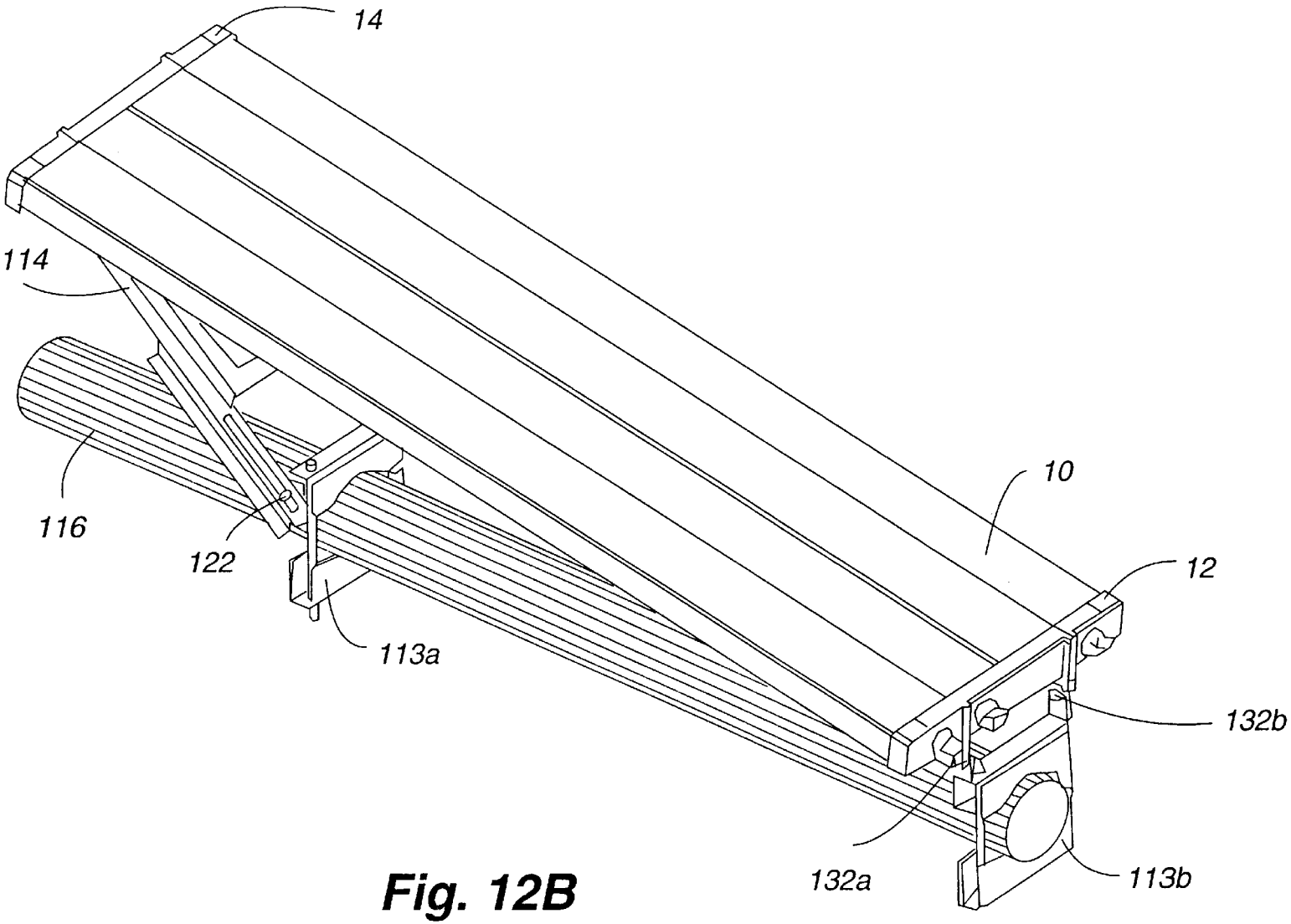

FIG. 12*b* illustrates the antenna system 10 mounted on a pole 116 using bracketing system 110. As illustrated, the lower clamp 113*b* is pivotally connected to the end flange 12 at pivot points 132*a*, 132*b*. This pivotal connection allows the angle between the antenna system 10 and the pole 116 to be varied. In one embodiment, the bracketing system 110 is capable setting the angle of the antenna system 10 from +2 degrees from vertical to −10 degrees from vertical for a vertically oriented pole. In addition, although not shown in FIG. 12*b*, the brace 114 is pivotally connected to end flange 14 of the antenna system 10.

Figure 13:
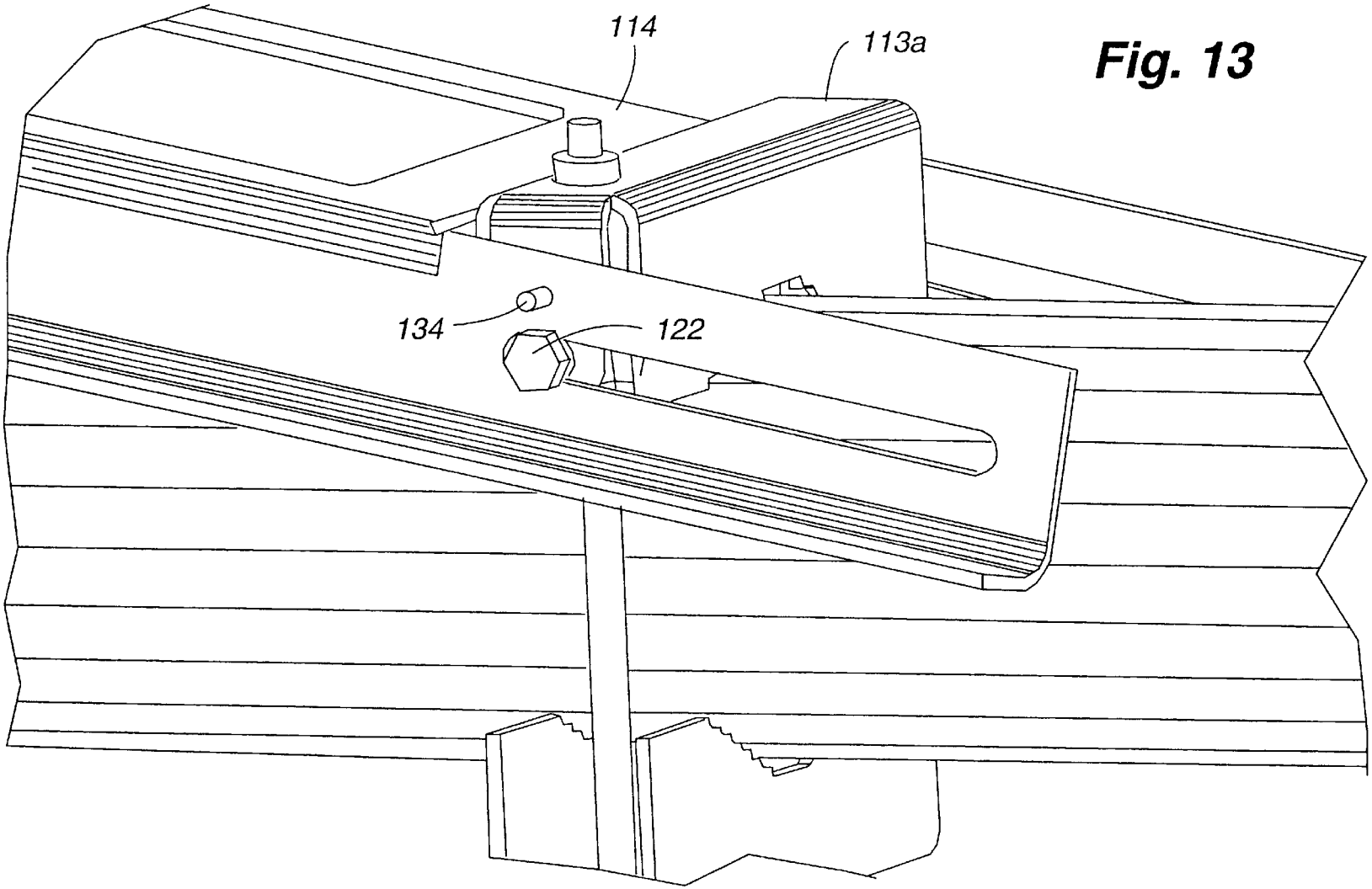
FIG. 13 illustrates a temporary locking mechanism used in the bracketing system of FIGS. 12*a* and 12*b*.

FIG. 13 is a close up view of a temporary locking feature that is used for locking the position of the brace 114 with respect to the clamp 113*a* during installation. Although only one side of the clamp/brace assembly is shown, it should be understood that both sides can include the locking feature. The locking feature greatly simplifies the installation process by reducing the effort required to correctly position the clamps 113*a*, 113*b* on the pole. The brace 114 and the upper clamp 113*a* each include an alignment hole having a diameter that is tailored to receive an alignment pin 134. The alignment holes are located so that, when aligned with one another using the alignment pin 134, the brace 114 is locked in a particular position with respect to the upper clamp 113*a*. Because the brace 114 is locked in position with respect to the upper clamp 113*a*, the distance between the clamps 113*a*, 113*b* is preset and a technician only needs to set the appropriate azimuth angle of the antenna system 10 and tighten the bolts on the clamps. After the two clamps 113*a*, 113*b* are properly positioned and secured to the pole 116, the alignment pin 134 can be removed and the elevation angle of the antenna system 10 can be adjusted. An angle indicator is machined into the brace 114 to simplify the angle adjustment. Once the proper angle is set, the bolts 122 are tightened to fix the elevation angle of the antenna system 10. In a preferred embodiment, the alignment holes are located so that alignment sets the antenna system 10 in a vertical position (i.e., zero degrees with respect to the pole 116) when the clamps are properly secured to the pole 116.

Although the present invention has been described in conjunction with its preferred embodiments, it is to be understood that modifications and variations may be resorted to without departing from the spirit and scope of the invention as those skilled in the art readily understand. Such modifications and variations are considered to be within the purview and scope of the invention and the appended claims.

What is claimed is:

1. An antenna system comprising:

a housing;

a ground plane located within said housing and separating a first circuitry layer from a second circuitry layer;

a radiating element, having an input/output port, for transferring radio frequency energy in a predetermined operational frequency range between said input/output port and free space, said radiating element being located on said first circuitry layer;

a first transmission line, having a first center conductor, for use in transferring radio frequency energy between a first signal node and said input/output port of said radiating element, wherein said first transmission line and said first signal node are located on said first circuitry layer;

a second transmission line, having a second center conductor, for use in transferring radio frequency energy between a second signal node and a third signal node, wherein said second transmission line and said second and third signal nodes are located on said second circuitry layer; and a transition for use in transferring radio frequency energy between said first signal node on said first circuitry layer and said second signal node on said second circuitry layer, wherein said transition, said first center conductor, and said second center conductor are collectively formed from a single, homogeneous metallic member having substantially uniform composition.

2. The antenna system of claim 1, further comprising:

a connector, coupled to said housing, for use in transferring radio frequency energy between said antenna system and an exterior environment, said connector having a connector center conductor; and a third transmission line, having a third center conductor, for use in transferring radio frequency energy between said connector and said third signal node;

wherein said connector center conductor is capacitively coupled to said third center conductor.

3. The antenna system of claim 1, further comprising:

dielectric support means for use in suspending transmission circuitry a substantially fixed perpendicular distance from said ground plane, said support means including at least one tapered support member having a wide end and a narrow end, wherein said narrow end contacts said transmission circuitry.

4. The antenna system of claim 1, further comprising:

an adjustable bracket, coupled to said housing, for use in mounting said antenna system to a vertically oriented support, said bracket including:

a first clamp capable of being fixedly attached to said vertically oriented support;

a brace having a first end and a second end, said brace being pivotally mounted to said housing at said first end and slidably mounted to said first clamp at said second end; and fastening means for securing said brace in a substantially fixed position with respect to said first clamp so that said antenna housing can be fixed at a desired angle with respect to said vertically oriented support.

5. The antenna system of claim 4, further comprising:

alignment means for temporarily locking said brace in a predetermined fixed position with respect to said first clamp during an initial installation period, wherein said alignment means is capable of rapid disengagement.

6. The antenna system of claim 4, further comprising:

a second clamp capable of being fixedly attached to said vertically oriented support, said second clamp being pivotally mounted to said housing.

7. The antenna system of claim 1, wherein:

said second transmission line comprises one of the following: a microstrip transmission line and a stripline transmission line.

8. The antenna system of claim 1, further comprising:

a mode suppressor, separate from said transition, for suppressing undesired transmission modes originating at said transition.

9. The antenna system of claim 8, wherein:

said mode suppressor comprises a conductive member that surrounds said transition on at least three sides.

10. The antenna system of claim 8, wherein:

said mode suppressor is substantially short circuited to ground in said predetermined operational frequency range of said radiating element.

11. The antenna system of claim 8, wherein said mode suppressor is capacitively coupled to ground.

* * * * *